US009011037B2

(12) United States Patent
Breault

(10) Patent No.: US 9,011,037 B2
(45) Date of Patent: Apr. 21, 2015

(54) MAT WITH INDENTED GRAPPLE RECEIVER

(76) Inventor: Marc Breault, Sturgeon (CA)

( * ) Notice: Subject to any disclaimer, the term of this patent is extended or adjusted under 35 U.S.C. 154(b) by 0 days.

(21) Appl. No.: 13/226,378

(22) Filed: Sep. 6, 2011

(65) Prior Publication Data

US 2013/0058715 A1 Mar. 7, 2013

(51) Int. Cl.
*E01C 9/08* (2006.01)
*E01C 5/00* (2006.01)

(52) U.S. Cl.
CPC ..... *E01C 9/08* (2013.01)

(58) Field of Classification Search
USPC ..... 404/34–36; 52/177, 125.2–125.5; 297/81.6, 81.61, 81.62
See application file for complete search history.

(56) References Cited

U.S. PATENT DOCUMENTS

| | | | | | |
|---|---|---|---|---|---|
| 163,506 | A | * | 5/1875 | Mock | 404/18 |
| 787,787 | A | * | 4/1905 | Peabody | 52/125.3 |
| 1,096,701 | A | * | 5/1914 | Emsley | 404/25 |
| 1,444,167 | A | * | 2/1923 | Cooper | 52/125.3 |
| 1,529,317 | A | * | 3/1925 | Ludeman | 52/125.3 |
| 1,854,324 | A | * | 4/1932 | Anderberg | 52/125.3 |
| D108,455 | S | * | 2/1938 | Poortinga | D25/116 |
| 2,115,160 | A | * | 4/1938 | Fowler | 52/100 |
| 2,371,017 | A | * | 3/1945 | Arthur | 404/36 |
| 2,375,454 | A | * | 5/1945 | Wichert | 404/36 |
| 2,819,026 | A | | 1/1958 | Leyendecker | |
| 3,534,668 | A | * | 10/1970 | Scheinoha | 404/45 |
| 3,861,106 | A | * | 1/1975 | Erhart | 52/166 |
| 4,296,909 | A | * | 10/1981 | Haeussler | 249/94 |
| 4,600,336 | A | | 7/1986 | Waller, Jr. | |
| 5,713,695 | A | * | 2/1998 | Rogers | 404/25 |
| 5,822,944 | A | | 10/1998 | Penland, Sr. | |
| 6,007,271 | A | * | 12/1999 | Cole et al. | 404/35 |
| 6,214,428 | B1 | * | 4/2001 | Henderson | 428/54 |
| 6,474,905 | B1 | | 11/2002 | Smith, Jr. | |
| 7,222,460 | B2 | * | 5/2007 | Francies et al. | 52/3 |
| 7,404,690 | B2 | * | 7/2008 | Lukasik et al. | 404/36 |
| 7,604,431 | B2 | * | 10/2009 | Fournier | 404/35 |
| 7,945,980 | B2 | * | 5/2011 | Zylman | 14/2.4 |
| 2004/0135389 | A1 | * | 7/2004 | Helms | 294/110.1 |
| 2004/0141809 | A1 | * | 7/2004 | Wagstaff | 404/35 |
| 2005/0161116 | A1 | * | 7/2005 | Chang | 144/346 |
| 2006/0034654 | A1 | * | 2/2006 | Sanders | 404/40 |
| 2007/0107271 | A1 | * | 5/2007 | Weagley et al. | 37/407 |
| 2008/0085154 | A1 | * | 4/2008 | Lukasik | 404/35 |

(Continued)

FOREIGN PATENT DOCUMENTS

CA 2163714 A1 5/1997

OTHER PUBLICATIONS

"Excavator Mat Grapple," © 2011 Weldco-Beales Manufacturing, <http://www.weldco-beales.com/Portals/0/uploads/excavator_mat_grapple_brochure.pdf>, as early as Oct. 2009, 1-page brochure.

(Continued)

*Primary Examiner* — Abigail A Risic
(74) *Attorney, Agent, or Firm* — Christensen O'Connor Johnson Kindness PLLC

(57) ABSTRACT

A mat with an upper road side and a lower ground contacting side, the mat comprising: a frame supporting one or more boards; and a grapple receiver formed in an interior portion of the mat and indented from one or both of the upper road side and the lower ground contacting side to allow grapple jaws to grip the grapple receiver between the grapple jaws.

13 Claims, 2 Drawing Sheets

(56) References Cited

U.S. PATENT DOCUMENTS

| | | | | |
|---|---|---|---|---|
| 2008/0292397 | A1* | 11/2008 | Farney et al. | 404/32 |
| 2009/0087261 | A1* | 4/2009 | Fournier | 404/35 |
| 2009/0297266 | A1* | 12/2009 | Stasiewich et al. | 404/36 |

OTHER PUBLICATIONS

"Log Grapple," © 2011 Weldco-Beales Manufacturing, <http://www.weldco-beales.com/ProductDetails/tabid/75/Default.aspx?productid=73&category=2> [accessed Aug. 2011], 1 page.

"Rig Access Mats," © 2010 Revcon Rentals, <http://revcon.ca/what-we-do/rentals/rig-access-mats> [accessed May 18, 2011], 4 pages.

"Wheel Loader Log and Lumber Grapple", © 2011 Weldco-Beales Manufacturing, <http://www.weldco-beales.com/ProductDetails/tabid/75/Default.aspx?productid=71&category=2>, as early as Sep. 2007, 1-page brochure.

"Wheel Loader Mat Grapple," © 2011 Weldco-Beales Manufacturing, <http://www.weldco-beales.com/Portals/0/uploads/WL_MatGrapple.pdf>, as early as 2007, 1-page brochure.

* cited by examiner

MAT WITH INDENTED GRAPPLE RECEIVER

TECHNICAL FIELD

This document relates to mats with indented grapple receivers.

BACKGROUND

In the oil and gas industry, it is sometimes necessary to provide ground cover mats with sufficient strength to support heavy equipment and transport trucks over wet or disturbed ground. Such mats may be maneuvered into place with a variety of application specific mat gripping attachments operated by a loader or excavator for example.

SUMMARY

A mat with an upper road side and a lower ground contacting side, the mat comprising: a frame supporting one or more boards; and a grapple receiver formed in an interior portion of the mat and indented from one or both of the upper road side and the lower ground contacting side to allow grapple jaws to grip the grapple receiver between the grapple jaws.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Oil field exploration and drilling operations are often undertaken in geographic areas that are, in their natural state, inaccessible to vehicles and equipment necessary for such exploration. These areas include swamps, marshlands, riverbeds, snow covered regions, and areas with soft or sandy soil. In order to explore for oil in such areas, it is necessary to locate heavy drilling rigs, vehicles and other equipment for some period of time on or adjacent to the location where the well is to be drilled. In order to transport this heavy equipment to the site and to support the equipment at the site, the industry has used for many years temporary roads leading to and from the site and flooring systems or pads at the particular site.

Existing flooring systems may involve a series of prefabricated mats that may or may not interlock with one another. Mats are currently used for temporary road and access track in many other industries as well. Such mats may be generally used as alternatives to asphalt and concrete road paving, or for temporary storage pads for supplies and equipment. In contrast with traditional surfaces made with asphalt, gravel, or concrete, temporary road mats: may cause less of a negative environmental impact, may be quicker and easier to set up, and may be easier to obtain required building permits for. Mats may also be used as temporary road track and paving for portable boat or sea plane ramps.

Mats may be transported by truck to a job site, unloaded, positioned, and connected together. There are a variety of methods to unload and position the mats. For example, a variety of aftermarket mat grapples may be used for this purpose. A mat grapple designed for an excavator may pick the mat up by the sides of the mat, while a mat grapple designed for a loader may pick the mat up by gripping the center of the mat between a pair of forklift beams below and a specialized jaw above the mat. Other methods of unloading and positioning mats include using a crane or other loading machine to lift the mats for example by attaching cables through one or more eyelets spaced about the perimeter of the mat frame.

Figures 1, 2, 3, 4:
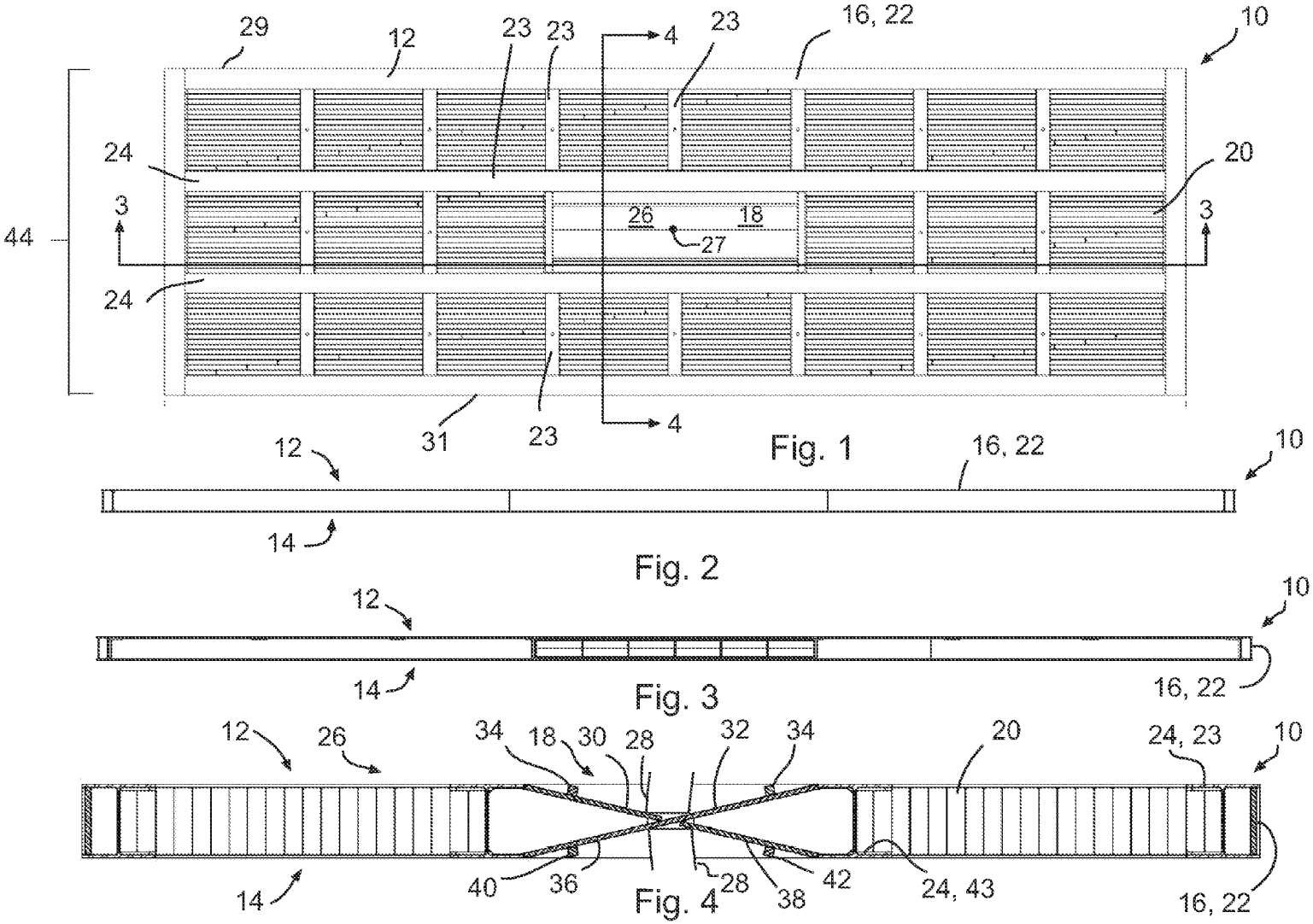
FIG. 1 is a top plan view of a mat as disclosed herein.
FIG. 2 is a side elevation view of the mat of FIG. 1.
FIG. 3 is a section view taken along the 3-3 section lines from FIG. 1.
FIG. 4 is a section view taken along the 4-4 section lines from FIG. 1.
Figure 5:
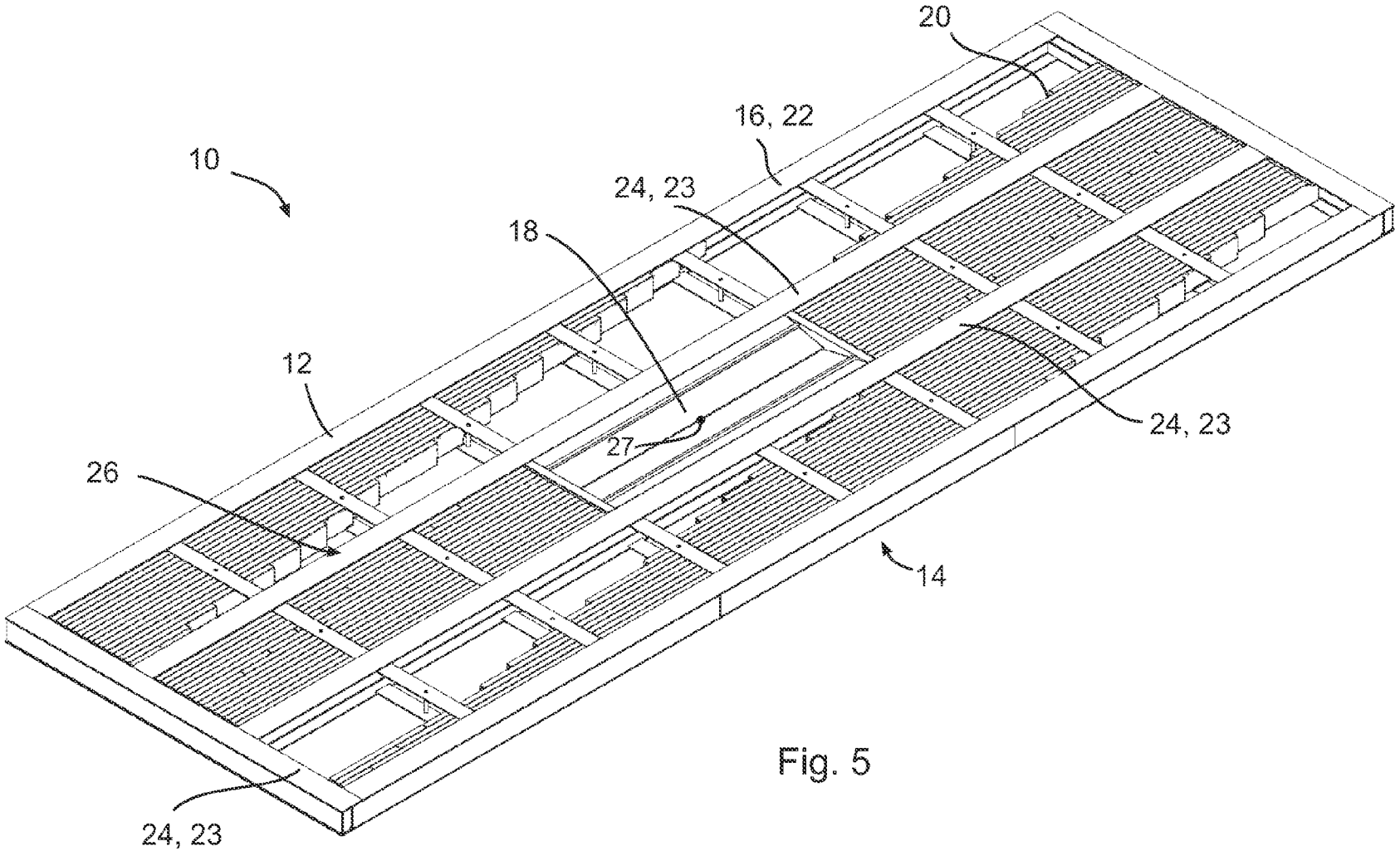
FIG. 5 is a perspective view of the mat of FIG. 1 with a portion of the boards removed for illustration.

Referring to FIGS. 1-5, a mat 10 is illustrated having an upper road side 12 and a lower ground contacting side 14. Mat 10 may comprise a frame 16 and a grapple receiver 18 (FIGS. 1, 4, and 5). Frame 16 supports one or more boards 20, for example a plurality of boards 20 as shown. Frame 16 may form a retaining structure 22 as shown to cage boards 20. In other embodiments, frame 16 merely provides structural support to the one or more boards 20, which may be secured on top of frame 16. Frame 16 may be made of suitable material such as metal to provide sufficient strength for the desired application of mat 10. Plural boards 20 may be laminated boards side stacked and retained within frame 16 as shown, although other suitable types of boards and board stacking techniques may be used. Frame 16 may retain boards 20 using a series of frame members 23, such as I-beams 24, that cross one another to secure boards 20 in place.

Referring to FIGS. 1, 4, and 5, grapple receiver 18 is formed in an interior portion 26 of the mat 10, for example at a center of gravity 27 of the mat 10. Grapple receiver 18 is illustrated as being indented from the upper road side 12 and the lower ground contacting side 14 to allow grapple jaws 28 to grip the grapple receiver 18 between the grapple jaws 28. Grapple jaws 28 may be conventional grapple jaws that are provided as standard attachments on loaders, excavators, and other heavy duty lifting equipment that may be present at the job site. Positioning the grapple receiver 18 in interior portion 26 spaces the grapple receiver 18 from a perimeter edge 29 of mat 10 and allows the mat 10 to be gripped with grapple jaws 28 that have a maximum bite length that is shorter than a lateral width 44 (FIG. 1) of the mat 10, because the jaws 28 need only have sufficient bite length to reach grapple receiver 18 from a lateral edge 31 of the mat 10. Allowing the mat 10 to be gripped between the jaws 28 instead of merely providing a vertical hole entirely through the mat 10 for jaws 28 to overbite through also allows jaws 28 to grip mat 10 more stably, which allows mat 10 to be more safely and securely maneuvered into place. Mat 10 may also be operated by a variety of aftermarket grapple jaws (not shown) or other suitable grappling equipment such as a log grapple.

Referring to FIG. 4, the grapple receiver 18 may be indented with converging tapered surfaces 30, 32, for example to assist in positioning or centralizing grapple jaws 28 around mat 10 upon jaw closure. Properly positioning jaws 28 upon closure at a desired location allows the mat 10 to be balanced, for example at a center of gravity 27 of mat 10, of mat 10, and thus more efficiently maneuvered into place. Thus, grapple receiver 18 acts like a thumb grip. Stops 34 may be provided on each converging tapered surface 30, 32 for preventing over or under biting and for further assisting the positioning of jaws 28 at the desired bite point upon jaw closure. As shown, the grapple receiver 18 may be indented from both the upper road side 12 and the lower ground contacting side 14, for example if grapple receiver 18 has lower converging tapered surfaces 36 and 38, and respective stops 40 and 42. Regardless, in some cases grapple receiver 18 is only indented from one of the upper road side 12 and the lower ground contacting side 14.

Grapple receiver 18 may be rigidly connected to the frame 16 as is shown for strength. Referring to FIG. 1, in some embodiments the mat 10 has a lateral width 44 sufficiently narrow to allow horizontal transportation, for example on a truck bed, without the use of a pilot vehicle. For example, the lateral width 44 may be twelve feet six inches or less. Without a pilot vehicle, transportation costs savings are realized. Widths of eight feet or less may also be used. Mat 10 may be adapted to interlock laterally (not shown) with adjacent mats 10 to form a contiguous mat surface, for example to provide a temporary road surface. Other applications include use of mats 10 to provide runways, roads, landing pads, and building foundation slabs. A cover (not shown) may be provided for covering the indented grapple receiver 18 after mat 10 is positioned.

Although described primarily for oilfield applications, mat 10 may be used in other suitable applications where a mat 10 could be beneficially used.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A mat with an upper road side, a center of gravity, and a lower ground contacting side, the mat comprising:

a frame comprising beams that form a grid and retain one or more boards between the beams, the beams comprising interior and exterior beams, the frame having a perimeter defined by the exterior beams, with four interior beams connected together to define an interior portion of the mat, the interior portion bounded by the four interior beams; and a grapple receiver secured by the four interior beams, formed in the interior portion of the mat and spaced from the perimeter, the grapple receiver being indented from one or both of the upper road side and the lower ground contacting side to have a thickness, measured perpendicularly to the upper road side and the lower ground contacting side, that has a minimum at the center of gravity of the mat, to allow grapple jaws to grip and hold the grapple receiver between the grapple jaws.

2. The mat of claim 1 in which the grapple receiver is indented from:

the upper road side by a first pair of surfaces that are sloped towards one another; and the lower ground contacting side by a second pair of surfaces that are sloped towards one another.

3. The mat of claim 1 in which the grapple receiver is indented from both the upper road side and the lower ground contacting side.

4. The mat of claim 1 in which the frame is made of metal.

5. The mat of claim 1 in which the mat has a lateral width sufficiently narrow to allow horizontal transportation without the use of a pilot vehicle.

6. The mat of claim 5 in which the lateral width is twelve feet six inches or less.

7. The mat of claim 1 in which the frame supports plural boards.

8. The mat of claim 1 in which the beams comprise I-beams.

9. A mat, comprising:

a metal frame comprising beams that form a grid and retain boards between the beams, the beams comprising interior and exterior beams, the boards forming working surfaces on opposed sides of the mat, the metal frame having a perimeter defined by the exterior beams, with four interior beams connected together to define an interior portion of the mat, the interior portion bounded by the four interior beams;

the metal frame being rectangular, and having a width and a length greater than the width;

the width of the metal frame being selected to permit transportation of the mat without the use of a pilot vehicle when the mat is lying on one of the working surfaces;

the mat having a center of gravity; and a grapple receiver secured by the four interior beams, formed in the interior portion of the mat and spaced from the perimeter, the grapple receiver being indented from at least one of the working surfaces of the mat to have a thickness, measured perpendicularly to the working surfaces of the mat, that has a minimum at a center of gravity of the mat, to allow grapple jaws to grip and hold the grapple receiver between the grapple jaws.

10. The mat of claim 9, in which the grapple receiver is indented from each of the working surfaces of the mat by a respective pair of surfaces that are sloped towards one another, and further comprising stops on each of the respective pairs of surfaces.

11. The mat of claim 9 in which the width is twelve feet six inches or less.

12. The mat of claim 2 further comprising stops on each of the first pair of surfaces and the second pair of surfaces.

13. The mat of claim 9 in which the beams comprise I-beams.

* * * * *